US007479165B2

(12) United States Patent
Birker et al.

(10) Patent No.: US 7,479,165 B2
(45) Date of Patent: Jan. 20, 2009

(54) METHOD OF LAUNDRY WASHING

(75) Inventors: Paul Johan Birker, Vlaardingen (NL); Philippus Cornelis Van Der Hoeven, Vlaardingen (NL); Cornelis Gerhard Van Kralingen, Vlaardingen (NL); Pieter Broer Van Der Weg, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 250 days.

(21) Appl. No.: 11/008,766

(22) Filed: Dec. 9, 2004

(65) Prior Publication Data

US 2005/0130860 A1 Jun. 16, 2005

(30) Foreign Application Priority Data

Dec. 11, 2003 (EP) ..... 03078921
Oct. 8, 2004 (EP) ..... 04077790

(51) Int. Cl.
*D06L 1/00* (2006.01)
*D06L 1/12* (2006.01)

(52) U.S. Cl. ..... 8/137

(58) Field of Classification Search ..... 8/137
See application file for complete search history.

(56) References Cited

U.S. PATENT DOCUMENTS 3,944,497 A * 3/1976 Alterman et al. ..... 510/381
4,141,467 A * 2/1979 Augustijn et al. ..... 222/38
4,489,455 A * 12/1984 Spendel ..... 8/158
4,555,019 A 11/1985 Spendel
4,999,124 A * 3/1991 Copeland ..... 510/514
5,453,216 A 9/1995 Kellett
5,863,877 A * 1/1999 Carr et al. ..... 510/348
5,965,505 A 10/1999 Baillely et al.
5,972,870 A * 10/1999 Anderson ..... 510/298
2003/0182732 A1 10/2003 Davenet et al.

FOREIGN PATENT DOCUMENTS

GB 2313603 A 12/1997
WO 03/080916 A1 10/2003

OTHER PUBLICATIONS

Patents Abstract of Japan, vol. 0183, No. 34 abstracting JP 6 079092 A to Hidenobu Yagi (Mar. 22, 1994).
Patents Abstract of Japan, vol. 0174, No. 89 abstracting JP 5 123489 A to Matsushita Electric Ind. Co. Ltd. (May 21, 1993).

* cited by examiner

*Primary Examiner*—Lorna M Douyon
(74) *Attorney, Agent, or Firm*—Ronald A. Koatz

(57) ABSTRACT

The invention provides a method of washing a laundry fabric in a wash liquor in a washing machine, the wash liquor containing surfactant material, wherein during a single wash cycle no more than 10% by weight of the wash liquor is drained from the washing machine, wherein the concentration of the surfactant material in the wash liquor is substantially constant during the wash cycle, and wherein the method comprises the step of changing the ionic strength of the wash liquor by addition of one or more ionic ingredients thereto during the wash cycle.

9 Claims, No Drawings

METHOD OF LAUNDRY WASHING

TECHNICAL FIELD

The present invention relates to a method of laundry washing in a washing machine, wherein the concentration of one or more ingredients changes during a wash cycle.

BACKGROUND TO THE INVENTION

Washing machines commonly operate on a cyclical programme basis. For example, a typical wash will comprise a wash cycle, a rinse cycle and a spin cycle when the clothes are respectively, washed, rinsed and spin dried. There is normally a draining of liquor between these respective cycles. It is known to provide a pre-wash cycle before the main wash cycle, when it is desired to clean heavily soiled items. Again, there is normally a draining of the pre-wash liquor before dosing of the main wash liquor and execution of the wash cycle.

In the pre-wash, normally the same laundry cleaning product is used as in the main wash. However, it is also known to provide pre-wash compositions to be used in the pre-wash cycle alone, or in combination with some of the main wash composition. These pre-wash products or additives are often formulated so as to attack particularly difficult kinds of soil. When a pre-wash cycle is not used, tough stains may be pre-treated by for example applying undiluted detergent composition to the stained area before laundry is washed in the main wash-cycle. However, the use of a pre-wash cycle or pre-treatment costs extra time and energy. Therefore, there is still a need for an energy efficient laundry cleaning method which optimises the cleaning ability of cost-effective cleaning products.

WO-03/080916 discloses a washing method in a washing machine, wherein laundry is soaked effectively and conveniently. The washing method described in this document includes the steps of (1) loading laundry into the tub of the washing machine, (2) supplying the tub with washing water such that the water level increases step by step and (3) repeatedly soaking the laundry. Furthermore, U.S. Pat. No. 4,555,019 discloses a method of washing a laundry fabric in a wash liquor in a washing machine, wherein first a concentrated aqueous wash liquor is distributed onto the laundry, and subsequently rinse liquor (i.e. fresh water) is added. It can be noticed that in both of these prior art methods, the concentration of detergent material in the washing water within the tub is reduced significantly.

On the other hand, US-2003/0182732 discloses a portable, self-contained device for dosing and/or dispensing a detergent composition into an appliance for treating fabric. Furthermore, JP-6 079092 and JP-5 123489 disclose methods for refining water using electrolysis. In addition U.S. Pat. No. 5,965,505 can be mentioned which document discloses a detergent composition containing a heavy metal ion sequestrant and an organic peroxyacid bleaching system, whereby means is provided for delaying the release to a wash system of said bleach system.

We have now discovered that in a single wash cycle, a change in the wash liquor content can optimise the cleaning ability of the wash liquor.

The present invention resides in changing the ionic strength of the wash liquor during the wash cycle, whereby the concentration of surfactant material in the wash liquor is kept substantially constant during the wash cycle.

Although not wishing to be bound by theory, it is hypothesised that this influences the interaction between the stain and the surfactant (or a mixture thereof) enabling the removal of a wider variety of stains.

DEFINITION OF THE INVENTION

Accordingly, the present invention provides a method of washing a laundry fabric in a wash liquor in a washing machine, said wash liquor containing surfactant material, wherein during a single wash cycle no more than 10% by weight of the wash liquor is drained from the washing machine, wherein the concentration of the surfactant material in the wash liquor is substantially constant during the wash cycle, and wherein said method comprises the step of changing the ionic strength of the wash liquor by addition of one or more ionic ingredients thereto during the wash cycle.

In connection with the present invention, the washing machine in which the method of the invention is carried out is intended to be a common European laundry washing machine.

DETAILED DESCRIPTION OF THE INVENTION

The Wash Cycle

As opposed to having separate pre-wash and wash cycles, in the context of the present invention, "a single wash cycle" is a washing regime during which a substantial amount of wash liquor is retained, i.e. is not drained. Preferably, this is effected by using two separate time phases respectively during which, the ionic strength is different from each other. During the entire wash cycle, particularly during the change from the first phase to the second phase in that wash cycle, some liquor may be drained but it will be no more than 10%, preferably no more than 1% by weight of the wash liquor and most preferably, substantially no wash liquor will be drained away.

The ionic strength of the wash liquor may be changed gradually during whole or part of the wash cycle or it may change more abruptly between at least a first phase and a second phase of the cycle. The change in ionic strength is deliberately effected by controlled dosing of additional materials. Due to the nature of this process for changing the ionic strength, an "abrupt" change may actually take some time but the slope of the curve of ionic concentration versus time would preferably be higher than in a period of gradual change, as referred to above.

The ionic strength of the liquor is different in the first phase from the second phase. One way in which this may be effected, as described in more detail herein below, may be by use of a delayed release formulation. However, in the initial part of any wash cycle, there is at first a dissolution and/or dispersion of the laundry cleaning composition until it reaches an equilibrium concentration. That build-up period is to be disregarded and the ionic strength of the wash liquor during the first phase is that after initial dispersion/dissolution and reaching of equilibrium. The second phase is then initiated by a functional change by the addition or one or more ionic ingredients, with dispersion/dissolution of any such additive to reach a new equilibrium ionic strength.

Addition of such an ingredient or ingredients to change the ionic strength so as to reach the second phase may be effected by dosing from a dosing device attached to the machine, cycling at least part of the wash liquor through an external dosing device and back into the machine or use of a delayed release formulation (eg a temperature sensitive delayed release formulation whereby a controlled increase or decrease in the wash liquor temperature initiates release of the additive ingredient(s)). Preferably, a delayed release formulation is used for changing the ionic strength.

As a result of the addition of the one or more ionic ingredients, the ionic strength of the wash liquor in the second phase is higher than that in the first phase. The first phase should be considered to start from the time of reaching substantial equilibrium of the ionic species in the liquor and to end with the action to initiate changing the ionic strength for the second phase. The second phase begins at the time of reaching the new substantial equilibrium in ionic strength and ends with the initiation of either a further change to alter the ionic strength again, or to drain the wash liquor before a rinse cycle. If more than two phases are utilised, their initiation and end is signified as for the second phase. In any event, any phase is independently preferably of duration from 2 to 60 minutes, more preferably from 2 to 30 minutes, even more preferably from 3 to 20 minutes and most preferably from 4 to 15 minutes. However, as mentioned above, the present invention does not necessarily involve use of discrete phases and gradual changes of ionic strength are also possible.

The ionic strength of the wash liquor depends on the amount and types of water soluble salt(s) in the detergent product applied and dissolved in the liquor. Use of varying salt concentration, alone or optionally in combination with changing temperature, has been found to improve the removal or even reduce the need for higher temperatures. It therefore contributes to an overall energy saving in the wash process.

Although in principle, the present invention may be effected at any desired temperature, most preferably the wash liquor during variation of ionic strength is in the temperature range for its most time, of from 5° C. to 100° C., more preferably from 5° C. to 60° C., still more preferably from 5° C. to 38° C. and most preferably from 10° C. to 30° C. However, as indicated above, the separate phases may in principle be effected at generally different temperatures from each other.

An ion is an atom or group of atoms that is not electronically neutral but instead carries a positive or negative charge, as a result of the loss of take-up of an electron. In solution the total concentration of ions is defined as:

$$\text{Ionic Strength (in mol per liter or M)} = IS = \tfrac{1}{2} \times (m_1 Z_1^2 + m_2 Z_2^2 + m_3 Z_3^2 + \ldots),$$

where $m_1, m_2, m_3, \ldots$ represent the molar concentration of the various ions in the solution, and $Z_1, Z_2, Z_3, \ldots$ are their respective charges.

For example, using this, the IS of a 0.1 M solution of potassiumnitrate ($KNO_3$) is calculated as follows:

$$m_{K^+} \text{and } m\text{NO}_{3_} = 0.1. \text{ Hence, } IS = \tfrac{1}{2} \times (0.1 \times 1^2 + 0.1 \times 1^2) = 0.1 \text{ M.}$$

Likewise that of a 0.1 M solution of sodiumsulphate ($Na_2SO_4$) is calculated by:

$$m_{Na}{}^{+} = 0.2 \text{ and } m_{SO4}{}^{-2} = 0.1. \text{ Hence, } IS = \tfrac{1}{2} \times (0.2 \times 1^2 + 0.1 \times 2^2) = 0.3 \text{ M.}$$

Ionic strength is measured by measuring conductivity of a diluted concentration of ions and taking into account the respective activity coefficients i.e. 0.9 or higher for most mentioned salts applied in detergent products in the concentration range from 0.001 M to 0.01 M concentration. The activity coefficient decreases gradually at higher concentrations.

Typical salts comprise sodium, potassium or ammonium salts of sulphate, triphosphate, phosphate, chloride, citrate, carbonate, percarbonate, perborate, silicate, natural soaps, acetates, alumiumsilicate (incl. Zeolites), nitrilotriacetates, alkyl sulphonates (incl. alkylbenzene sulphonates) or alkyl sulphates (incl. alkylethoxy or alkylpropoxy sulphates) and mixtures thereof. Many of these materials are normal ingredients in laundry wash compositions as will be further described hereinbelow. In special cases, magnesium salts of these materials may also be used.

A preferred list of salts comprises the sodium or magnesium salts of sulphate, carbonate, citrate, percarbonate, perborate, silicate, natural soaps and Zeolite. However, the ionic strength of the wash liquor is mainly determined by those salts which are readily water-soluble at the relevant wash liquor temperature.

The ionic strengths of conventional wash liquor solutions depend on the composition of the product in question and its dosing rates. Further, different product forms (low bulk density powders, concentrated or high bulk density powders, tablets, liquids etc) as well as the particular type within a format (eg for heavy duty or for delicate or coloured washes) have different compositions of dissociable salts and therefore represent a broad range of ionic strengths in the wash liquors in practice. Roughly speaking, wash liquors of single phase isotropic liquids for delicates, as well as non-soap detergent (NSD) bars deliver a low ionic strength (eg 0.001M to 0.03M), modern high bulk density zeolite-built powders deliver a moderate ionic strength (eg. 0.02M to 0.1M) and traditional low density phosphate-built powders deliver a high ionic strength (e.g. 0.06 M to 0.2 M). The product dosage per wash also varies and this contributes to the range of ionic strengths resulting from the different product types. The moderate ionic strengths of the high bulk density powders constitutes a significant cause of their shortcoming in removal of specific stains in comparison to that of traditional lower bulk density powders that have much higher ionic strengths. Moreover, the latter are conventionally dosed at higher rates.

The ionic strength in the first phase is preferably from 0.001 to 0.06, more preferably from 0.002 to 0.04, still more preferably from 0.003 to 0.03 and most preferably from 0.005 to 0.02 M. In the case of the second phase in which the wash liquor has a relatively higher ionic strength, its ionic strength is preferably from 0.01 to 0.5, more preferably from 0.02 to 0.3, still more preferably from 0.03 to 0.2 and most preferably from 0.04 to 0.15 M. It will be appreciated that in some cases, these respective ranges for the two phases overlap. However, it is a requirement that the actual values are different between the two phases during all, or at least part of the respective time periods of those phases.

The Wash Liquor

The wash liquor contains surfactant material of which the concentration is substantially constant during the wash cycle. This means that the change of said concentration during the wash cycle is lower than 10%, preferably lower than 5%.

Anionic Surfactants

Preferably, the wash liquor comprises at least one anionic surfactant. Preferably in either or both phases, its concentration s from 0.1 g/l to 10 g/l, more preferably from 0.3 g/l to 4 g/l, even more preferably from 0.4 to 2 g/l. It may for example be selected from one or more of alkylbenzene sulphonates, alkyl sulphonates, primary and secondary alkyl sulphates (in free acid and/or salt forms). The total amount of anionic surfactant may be from 0.001% to 75% by weight of the added composition.

A composition according to the present invention may, for example contain from 0.1% to 70%, preferably from 1% to 40%, more preferably from 2% to 30%, especially from 3% to 20% of alkylbenzene sulphonic acid surfactant (in free acid and/or salt form), or primary alcohol sulphate surfactant or a mixture of these two in any ratio.

When it is desired to enhance calcium tolerance, then any anionic surfactant in the composition may comprise (preferably at a level of 70 wt % or more of the total anionic surfactant) or consist only of one or more calcium-tolerant non-soap anionic surfactants.

As referred to herein, a "calcium tolerant" anionic surfactant is one that does not precipitate at a surfactant concentration of 0.4 g/l (and at an ionic strength of a 0.040 M 1:1 salt solution) with a calcium concentration up to 20° FH (French hardness degrees), i.e. 200 ppm calcium carbonate.

A preferred additional class of non-soap calcium tolerant anionic surfactants for use in the compositions of the present invention comprises the alpha-olefin sulphonate.

Another preferred class on calcium tolerant anionic surfactants comprise the mid-chain branched materials disclosed in WO-A-97/39087, WO-A-97/39088, WO-A-97/39089, WO-A-97/39090, WO-A-98/23712, WO-A-99/19428, WO-A-99/19430, WO-A-99/19436, WO-A-99/19437, WO-A-99/19455, WO-A-99/20722, WO-A-99/05082, WO-A-99/05084, WO-A-99/05241, WO-A-99/05242, WO-A-99/05243, WO-A-99/05244 and WO-A-99/07656.

Yet another suitable class of calcium tolerant anionic surfactants comprises the alkyl ether sulphates (ie the (poly) alkoxylated alkyl sulphates).

Another suitable calcium tolerant anionic surfactants to be used in combination comprises alpha-olefin sulphonate and alkyl ether sulphate in a weight ratio of from 5:1 to 1:15.

Other calcium-tolerant anionic surfactants that may be used are alkyl ethoxy carboxylate surfactants (for example, Neodox (Trade Mark) ex Shell), fatty acid ester sulphonates (for example, FAES MC-48 and ML-40 ex Stepan), alkyl xylene or toluene sulphonates, dialkyl sulphosuccinates, alkyl amide sulphates, sorpholipids, alkyl glycoside sulphates and alkali metal (e.g. sodium) salts of saturated or unsaturated fatty acids.

Yet other suitable anionic surfactants in addition to the calcium tolerant anionics are well-known to those skilled in the art. Examples include primary and secondary alkyl sulphates, particularly $C_8$-$C_{15}$ primary alkyl sulphates; and dialkyl sulphosuccinates. Sodium salts are generally preferred.

Soaps

Optionally, a soap may also be present in either or both phases in the wash liquor. Preferably, the concentration is from 0.01 g/l to 10 g/l, more preferably from 0.03 g/l to 4 g/l and most preferably from 0.05 g/l to 2 g/l. Suitable soaps include those having a chain length ranging from $C_{12}$ to $C_{20}$, mainly saturated, and optionally containing limited levels of 1 or 2 unsaturated bonds, and derived from natural oils and fats such as for example: (hardened or non-hardened) Tallow, Coconut, or Palm Kernel.

In a solid formulation, the amount of optional soap is preferably from 0.1% to 10%, more preferably from 0.1% to 5% by weight of the composition. In liquid compositions, the level of optional soap is preferably from 0.1% to 20%, more preferably from 5% to 15% by weight of the composition.

Optional Other Surfactants

Optional other surfactants include nonionic surfactants, cationic surfactants (for detergency enhancement and/or fabric softening), amphoteric and zwitterionic surfactants.

If desired, nonionic surfactant may also be included in either or both phases. Preferably, the concentration will be from 0.1 g/l to 10 g/l, more preferably from 0.3 g/l to 4 g/l and most preferably from 0.4 g/l to 2 g/l. The amount of these materials, in total, is preferably from 0.01% to 50%, preferably from 0.1% to 35%, more preferably from 0.5% to 25%, still more preferably from 0.7% to 20%, even more preferably from 0.8% to 15%, especially from 1% to 10% and even more especially from 1% to 7% by weight of the composition.

Preferred nonionic surfactants are ethoxylated aliphatic alcohols having an average degree of ethoxylation of from 2 to 12, more preferably from 3 to 10. Preferably, the aliphatic alcohols are $C_8$-$C_{16}$, more preferably $C_{10}$-$C_{15}$.

The mid-chain branched hydrophobe nonionics disclosed in WO-A-98/23712 are another class of suitable nonionic surfactants.

Suitable other non-ethoxylated nonionic surfactants include alkylpolyglycosides, glycerol monoethers, and polyhydroxyamides (glucamide).

Optionally, a composition according to the present invention may comprise from 0.05% to 10%, preferably from 0.1% to 5%, more preferably from 0.25% to 2.5%, especially from 0.5% to 1% by weight of cationic surfactant.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl)dimethyl ammonium chloride, are widely used in commercially available rinse conditioner compositions. Other examples of these cationic compounds are to be found in "Surfactants Science Series" volume 34 ed. Richmond 1990, volume 37 ed. Rubingh 1991 and volume 53 eds. Cross and Singer 1994, Marcel Dekker Inc. New York".

It is also possible to include certain mono-alkyl cationic surfactants which can be used for their detergency. Cationic surfactants that may be used for this purpose include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters).

Detergency Builders

In either or both phases, the wash liquor quite often also contains one or more detergency builders. Detergency builders can be considered to fall into two classes, namely those which are relatively soluble at the relevant wash liquor temperature(s) such as carbonates, phosphates (including orthophosphates and triphosphates, a common term for one of the latter being "sodium tripolyphosphate"), citrates, bicarbonates etc which contribute significantly to the ionic strength of the wash liquor. On the other hand, the second class comprises those relatively insoluble builders which do not contribute very much at all to ionic strength, for example the aluminosilicates (zeolites), silicates etc.

For the water soluble types, the total amount may be deduced from the aforementioned recited preferred etc ranges of ionic strengths rising from water soluble salts.

The concentration of water insoluble builders will preferably be from 0.01 g/l to 10 g/l, more preferably from 0.1 g/l to 4 g/l and most preferably from 0.5 g/l to 2 g/l. The total amount of detergency builder in the compositions will typically range from 1% to 80 wt %, preferably from 2% to 60 wt %, more preferably from 4% to 30% by weight of the total composition.

Inorganic builders that may be present include the soluble builders such as sodium carbonate, if desired in combination with a crystallisation seed for calcium carbonate, as disclosed in GB-A-1 437 950 and sodium bicarbonate; the insoluble crystalline and amorphous aluminosilicates, for example, zeolites as disclosed in GB-A-1 473 201, amorphous aluminosilicates as disclosed in GB-A-1 473 202 and mixed crystalline/amorphous aluminosilicates as disclosed in GB-A-1 470 250; and layered silicates as disclosed in EP-A-164 514. Soluble inorganic phosphate builders, for example, sodium orthophosphate, sodium pyrophosphate and sodium tri(poly) phosphate (STP) are also suitable for use with this invention. In this context "soluble" and "insoluble" are relative terms.

The compositions of the invention preferably contain an alkali metal, preferably sodium, aluminosilicate builder. Sodium aluminosilicates may generally be incorporated in amounts of from 10 to 70% by weight (anhydrous basis), preferably from 20 to 50 wt %.

When the aluminosilicate is zeolite, preferably the maximum amount is 30% by weight.

The alkali metal aluminosilicate may be either crystalline or amorphous or mixtures thereof, having the general formula:

$$0.8\text{-}1.5\ Na_2O.\ Al_2O_3.\ 0.8\text{-}6\ SiO_2.$$

These materials contain some bound water and are required to have a calcium ion exchange capacity of at least 50 mg Ca/g. The preferred sodium aluminosilicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB-A-1 429 143. The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070. Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally equivalent to at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 2 to 30 wt %, preferably from 5 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Bleaches

In either or both phases, the wash liquor may also suitably contain a bleach system. The total concentration of all bleaches or all bleach components is preferably from 0.001 g/l to 10 g/l, more preferably from 0.1 g/l to 1 g/l. Fabric washing compositions may desirably contain peroxygen bleaching agents and precursors thereof, for example, inorganic persalts or organic peroxyacids, capable of yielding hydrogen peroxide in aqueous solution.

Peroxygen bleaching agents include those peroxygen bleaching compounds which are capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such compounds may also be suitable.

Preferred peroxygen bleaching agents include peroxygen bleach selected from the group consisting of perborates, percarbonates, peroxyhydrates, peroxides, persulfates, and mixtures thereof. Specific preferred examples include: sodium perborate, commercially available in the form of mono- and tetra-hydrates, sodium carbonate peroxyhydrate, sodium pyrophosphate peroxyhydrate, urea peroxyhydrate, and sodium peroxide. Particular preferred are sodium perborate tetrahydrate, and especially, sodium perborate monohydrate. Sodium perborate monohydrate is especially preferred because it is very stable during storage and yet still dissolves very quickly in the bleaching solution. Sodium percarbonate may also be preferred for environmental reasons.

The amount thereof in the composition of the invention usually will be within the range of about 1-35% by weight, preferably from 5-25% by weight. One skilled in the art will appreciate that these amounts may be reduced in the presence of a bleach precursor e.g., N,N,N'N'-tetraacetyl ethylene diamine (TAED).

Another suitable hydrogen peroxide generating system is a combination of a C1-C4 alkanol oxidase and a C1-C4 alkanol, especially a combination of methanol oxidase (MOX) and ethanol or glucose oxidase (GOX) and glucose.

Alkylhydroperoxides are another class of peroxy bleaching compounds. Examples of these materials include cumene hydroperoxide, t-butylhydroperoxide and hydroperoxides originated from unsaturated compounds, such as unsaturated soaps Further, useful compounds as oxygen bleaches include superoxide salts, such as potassium superoxide, or peroxide salts, such as disodiumperoxide, calcium peroxide or magnesium peroxide.

Organic peroxyacids may also be suitable as the peroxy bleaching compound. Such materials normally have the general formula:

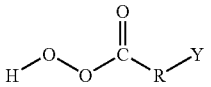

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH or

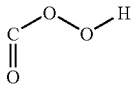

group (giving di(peroxyacids)) or a quaternary ammonium group.

Typical monoperoxy acids useful herein include, for example:

(i) peroxybenzoic acid and ring-substituted peroxybenzoic acids, e.g. peroxy-.alpha.-naphthoic acid or m-chloroperoxybenzoic acid (ii) aliphatic, substituted aliphatic and arylalkyl monoperoxyacids, e.g. peroxylauric acid, peroxystearic acid, 4-nonylamino-4-oxoperoxybutyric acid, and N,N -phthaloylaminoperoxy caproic acid (PAP); and (iii) 6-octylamino-6-oxo-caproic acid.

(iv) magnesium monoperoxophtalate hexahydrate, available from Interox.

(v) 6-nonylamino-6-oxoperoxycaproic acid (NAPAA)

(vi) Phtaloylimidoperoxycaproic acid

Typical diperoxyacids useful herein include, for example:

(vii) 1,12-diperoxydodecanedioic acid (DPDA);

(vii) 1,9-diperoxyazelaic acid;

(viii) diperoxytetradecanedioc acid (ix) diperoxyhexadecanedioc acid (x) diperoxybrassilic acid; diperoxysebasic acid and diperoxyisophthalic acid;

(xi) 2-decyldiperoxybutane-1,4-diotic acid; and (xii) 4,4'-sulphonylbisperoxybenzoic acid.

Also inorganic peroxyacid compounds are suitable, such as for example potassium monopersulphate (MPS). If organic or inorganic peroxyacids are used as the peroxygen compound, the amount thereof will normally be within the range of about 2-10% by weight, preferably from 4-8% by weight.

Peroxyacid bleach precursors are known and amply described in literature, such as in the British Patents 1,003,310 and 1,519,351; EP-A-185,522; EP-A-174,132; EP-A-120,591; and U.S. Pat. Nos. 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. Nos. 4,751,015 and 4,397,757, in EP-A-284292 and EP-A-331,229. Examples of peroxyacid bleach precursors of this class are:

2-(N,N,N-trimethyl ammonium)ethyl-4-sulphonylcarbonate (CSPC); as disclosed in U.S. Pat. No. 4,751,015;

N-octyl-N,N-dimethyl-N10-carbophenoxy decyl ammonium chloride (ODC);

and N,N,N-trimethyl ammonium toluyloxy benzene sulphonate.

A further special class of bleach precursors is formed by the cationic nitriles as disclosed EP-A-458,396 and EP-A-464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SSPC; trimethyl ammonium toluyloxy-benzene sulphonate; sodium nonanoyloxybenzene sulphonate (SNOBS); sodium 3,5,5-trimethyl hexanoyl-oxybenzene sulphonate (STHOBS); and the substituted cationic nitrites.

Each of the above precursor may be applied in mixtures, eg combination of TAED (hydrophylic precursor) with more hydrophobic precursor, such as sodium nonanoyloxybenzene sulphonate.

Alternatively, one may apply aromatic aldehydes and dioxygen as peroxy acid precursor, as disclosed in WO97/38074.

The precursors may be used in an amount of up to 12%, preferably from 2-10% by weight, of the composition.

Other classes of bleach precursors for use with the present invention are found in WO0015750 and WO9428104, for example 6-(nonanamidocaproyl)oxybenzene sulphonate. See WO0002990 for cylic imido bleach activators.

The precursors may be used in an amount of up to 12%, preferably from 2-10% by weight, of the composition.

The bleaching composition of the present invention has particular application in detergent formulations, especially for laundry cleaning. Accordingly, in another preferred embodiment, the present invention provides a detergent bleach composition comprising a bleaching composition as defined above and additionally a surface-active material, optionally together with detergency builder.

Also useful as bleaching agents in the compositions according to any aspect of the present invention are any of the known organic bleach catalysts, oxygen transfer agents or precursors therefor. These include the compounds themselves and/or their precursors, for example any suitable ketone for production of dioxiranes and/or any of the heteroatom containing analogs of dioxirane precursors or dioxiranes, such as sulfonimines

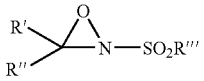

R1R2C=NS02R3 (EP 446 982 A) and sulfonyloxaziridines, for example:

EP 446,981 A. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. Nos. 5,360,568; 5,360,569 and 5,710,116.

Transition-metal bleach catalysts are well-known in the art. Various classes have been disclosed based on especially cobalt, manganese, iron and copper transition-metal complexes. Most of these bleach catalysts are claimed to yield hydrogen peroxide or peroxyacid activation, certain classes of compounds are also disclosed to give stain bleaching by atmospheric oxygen.

One type of manganese-containing bleach catalysts include the manganese-based complexes disclosed in U.S. Pat. Nos. 5,246,621 and 5,244,594. Preferred examples of theses catalysts include $[Mn^{IV}_2(\mu\text{-}O)_3(1,4,7\text{-trimethyl-}1,4,7\text{-triazacyclononane})_2](PF_6)_2$, $[Mn^{III}_2(\mu\text{-}O)(\mu\text{-}OAc)_2(1,4,7\text{-trimethyl-}1,4,7\text{-triazacyclononane})_2](ClO_4)_2$, $[Mn^{IV}_4(\mu\text{-}O)_6(1,4,7\text{-triazacyclononane})_4](ClO_4)_2$, $Mn^{III}Mn^{IV}(\mu\text{-}O)(\mu\text{-}OAc)_2(1,4,7\text{-trimethyl-}1,4,7\text{-triazacyclononane})_2](ClO_4)_3$, and mixtures thereof. See also EP-A-549,272. Other ligands suitable for use herein include 1,5,9-trimethyl-1,5,9-triazacyclododecane, 2-methyl-1,4,7-triazacyclononane, 2-methyl-1,4,7-trimethyl-1,4,7-triazacyclononane, and mixtures thereof. See also U.S. Pat. No. 5,194,416 which teaches mononuclear manganese (IV) complexes such as $[Mn(1,4,7\text{-trimethyl-}1,4,7\text{-triazacyclononane})(OCH_3)_3](PF_6)$. EP-A-549271 teaches the use of free ligand 1,4,7-trimethyl-1,4,7-triazacyclononane in detergent formulations. A dinuclear manganese compound, $[LMn^{III}Mn^{IV}(\mu\text{-}O)(\mu\text{-}OAc)_2](ClO_4)_2$ with L being an ethylene-bridged-bis(1,4-dimethyl-1,4,7-triazacyclononane) ligands has been disclosed in WO-96/06154.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylitol, arabitol, adonitol, meso-erythritol, meso-inositol, lactose, and mixtures thereof. U.S. Pat. No. 5,114,611 teaches another useful bleach catalyst comprising a complex of transition metals, including Mn, Co, Fe, or Cu, with an non-(macro)-cyclic ligand. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co—, Cu—, Mn—, or Fe— bispyridylmethane and bispyridylamine complexes. Highly preferred catalysts include Co(2,2'-bispyridylamine)$Cl_2$, Di(isothiocyanato)bispyridylamine-cobalt(II), trisdipyridylamine-cobalt(II)perchlorate, $[Co(2,2\text{-bispyridylamine})_2O_2]ClO_4$, Bis-(2,2'-bispyridylamine)copper(II) perchlorate, tris(di-2-pyridylamine)iron(II)perchlorate, and mixtures thereof.

Various manganese and iron complexes containing (pyridin-2ylmethyl)amine moieties as bleach catalysts are disclosed in EP-A-783035, EP-A-782998, EP-A-782999, WO-97/30144, WO-00/27975, WO-00/27976, WO-00/12667, and WO-00/12668. Preferred ligands include bis($CH_2COOH$)(pyridin-2-ylmethyl)amine, tris(pyridin-2ylmethyl)amine, bis(pyridin-2-ylmethylamine), N,N,N',N'-tetrakis(pyridin-2ylmethyl)-ethylenediamine, N,N,N',N'-tetrakis(benzimidazol-2ylmethyl)-propan-2-ol, N-methyl-N,N',N'-tris(3-methyl-pyridin-2ylmethyl)-ethylenediamine, N-methyl-N,N',N'-tris(5-methyl-pyridin-2ylmethyl)-ethylenediamine, N-methyl-N,N',N'-tris(3-ethyl-pyridin-2ylmethyl)-ethylenediamine, N-methyl-N,N',N'-tris(3-methyl-pyridin-2ylmethyl)-ethylenediamine.

A series of patent applications deal with iron complexes containing the bis(pyridin-2yl)methyl-amine moiety both for peroxy bleaching activation and atmospheric air bleaching of stains, i.e. WO9534628, EP0909809, WO0060044, WO0032731, WO0012667, and WO0012668, wherein the iron complexes containing N,N-bis(pyridin-2-yl-methyl)-1,1-bis(pyridin-2-yl)-1-aminoethane are often the most preferred catalysts.

Manganese complexes containing 1,10-phenanthroline and 2,2'-bipyridine as bleaching catalysts have been disclosed in WO-9615136 and WO-9964554.

Manganese complexes with Schiff-base ligands to bleach stains or dyes in solution have been disclosed in various patent applications (WO-A-00/53708, WO-A-97/44430, WO-A-97/07191, and WO-A-97/07192).

Another preferred class of manganese complexes include mononuclear manganese complexes containing cross-bridged macrocyclic ligands. These complexes have been claimed with peroxy compounds and without peroxy compounds present in the formulation (WO-A-98/39405 and WO-A-00/29537). The most preferred complexes include dichloro-5,12-dimethyl-1,5,8,12-tetraazabicyclo[6.6.2]hexadecane Manganese(II) and dichloro-4,10-dimethyl-1,4,7,10-tetraazabicyclo[5.5.2]tetradecane Manganese(II).

Further a class of manganese complexes containing bispidon as ligand has been disclosed as a family of bleach catalysts in the presence and absence of peroxy compounds (WO0060045), wherein dimethyl 2,4-di-(2-pyridyl)-3,7-dimethyl-3,7-diaza-bicyclo[3.3.1]nonan-9one-1,5-dicarboxylate is the preferred ligand.

Other bleach catalysts are described, for example, in EP-A-408,131 (dinuclear cobalt Schiff-base complex catalysts), EP-A-384,503, and EP-A-306,089 (metallo-porphyrin catalysts), U.S. Pat. No. 4,711,748 and EP-A-224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), U.S. Pat. No. 4,430,243 (chelants with manganese cations and non-catalytic metal cations), and U.S. Pat. No. 4,728,455 (manganese gluconate catalysts).

Another class of preferred cobalt catalysts having the formula $[Co(NH_3)_5Cl]Cl_2$ has been disclosed in EP-A-0 272 030. Yet another class of preferred of cobalt (III) catalysts $[Co(NH_3)_5(\text{carboxylate})]X_2$ (with X a non-coordinating anion), as disclosed in U.S. Pat. Nos. 580,001 and 508,198.

Inorganic polyoxometallates as bleaching/oxidation catalysts with peroxy bleaches and air have been claimed in various patent applications, i.e. WO-A-97/07886, WO-A-99/28426, and WO-A-00/39264.

The bleach catalysts may be used in an amount of up to 5%, preferably from 0.001-1% by weight, of the composition.

Chelating Agents

To the wash liquor in either or both phases may optionally be added, one or more heavy metal chelating agents. Generally, chelating agents suitable for use herein can be selected from the group consisting of aminocarboxylates, aminophosphonates, polyfunctionally-substituted aromatic chelating agents and mixtures thereof. Without intending to be bound by theory, it is believed that the benefit of these materials is due in part to their exceptional ability to remove heavy metal ions from washing solutions by formation of soluble chelates; other benefits include inorganic film or scale prevention. Other suitable chelating agents for use herein are the commercial DEQUESTO series, and chelants from Monsanto, DuPont, and Nalco, Inc.

Aminocarboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts therein and mixtures therein.

Aminophosphonates are also suitable for use as chelating agents in the compositions of the invention when at least low levels of total phosphorus are permitted in detergent compositions, and include ethylenediaminetetrakis(methylenephosphonates). Preferably, these aminophosphonates do not contain alkyl or alkenyl groups with more than about 6 carbon atoms.

Polyfunctionally-substituted aromatic chelating agents are also useful in the compositions herein. See U.S. Pat. No. 3,812,044. Preferred compounds of this type in acid form are dihydroxydisulfobenzenes such as 1,2-dihydroxy-3,5-disulfobenzene.

A chelator for use herein is ethylenediamine disuccinate ("EDDS"), especially (but not limited to) the [S,S] isomer as described in U.S. Pat. No. 4,704,233. The trisodium salt is preferred though other forms, such as magnesium salts, may also be useful.

If utilized, these chelating agents or transition-metal-selective sequestrants will preferably comprise from about 0.001% to about 10%, more preferably from about 0.05% to about 1% by weight of the added composition.

Enzymes

In either or both phases, the wash liquor may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4-12 are available and can be used in the instant invention. Examples of suitable proteolytic enzymes are the subtilisins which are obtained from particular strains of *B. Subtilis B. licheniformis,* such as the commercially available subtilisins Maxatase (Trade Mark), as supplied by Gist Brocades Nev., Delft, Holland, and Alcalase (Trade Mark), as supplied by Novo Industri A/S, Copenhagen, Denmark.

Particularly suitable is a protease obtained from a strain of *Bacillus* having maximum activity throughout the pH range of 8-12, being commercially available, e.g. from Novo Industri A/S under the registered trade-names Esperase (Trade Mark) and Savinase (Trade-Mark). The preparation of these and analogous enzymes is described in GB-A-1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

Other Optional Minor Ingredients

In either or both phases, the wash liquor may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Yet other materials that may be present in detergent compositions of the invention include sodium silicate; antiredeposition agents such as cellulosic polymers; inorganic salts such as sodium sulphate; lather control agents or lather boosters as appropriate; dyes; coloured speckles; perfumes; foam controllers; fluorescers and decoupling polymers. This list is not intended to be exhaustive.

Product Form

Compositions to be dosed in the wash liquor to carry out the method of the present invention may for example be provided as solid compositions such as powders or tablets, or non-solid compositions such as substantially aqueous or substantially non-aqueous liquids, gels or pastes. Optionally, liquid compositions may be provided in water soluble sachets. Non-solid, eg liquid, compositions may have different compositions from solid compositions and may for example comprise from 5% to 60%, preferably from 10% to 40% by weight of anionic surfactant (at least some of which will, of course, be aromaticalkyl sulphonic surfactant, from 2.5% to 60%, preferably from 5% to 35% by weight of nonionic surfactant and from 2% to 99% by weight of water. Optionally, liquid compositions may for example contain from 0.1% to 20%, preferably from 5% to 15% by weight of soap.

Non-solid, eg liquid, compositions may also (subject to any exclusions or other provisos expressed herein in the context of any aspect of the invention), comprise one or more hydrotropes, especially when an isotropic composition is required. Such hydrotropes may, for example, be selected from arylsulphonates, eg benzene sulphonate, any of which is optionally independently substituted on the aryl ring or ring system by one or more $C_{1-6}$ eg $C_{1-4}$ alkyl groups, benzoic acid, salicylic acid, naphthoic acid, $C_{1-6}$, preferably $C_{1-4}$ polyglucosides, mono-, di- and triethanolamine. Where any of these compounds may exist in acid or salt (whether organic or inorganic, such as sodium), either may be used provided compatible with the remainder of the formulation.

Preparation of the Compositions

The compositions to be added to the wash liquor may be prepared by any suitable process. The choice of processing route may be in part dictated by the stability or heat-sensitivity of the surfactants involved, and the form in which they are available.

For granular products, ingredients such as enzymes, bleach ingredients, sequestrants, polymers and perfumes which are traditionally added separately (e.g. enzymes postdosed as granules, perfumes sprayed on) may be added after the processing steps outlined below.

Suitable processes include:

(1) drum drying of principal ingredients, optionally followed by granulation or postdosing of additional ingredients;

(2) non-tower granulation of all ingredients in a high-speed mixer/granulator, for example, a Fukae (Trade Mark) FS series mixer, preferably with at least one surfactant in paste form so that the water in the surfactant paste can act as a binder;

(3) non-tower granulation in a high speed/moderate speed granulator combination, thin film flash drier/evaporator or fluid bed granulator.

The invention will now be illustrated by way of the following non-limiting examples.

EXAMPLE 1

Washing experiments were carried out at a total surfactant concentration of 0.1 wt % (1.0 g/L). The experiments were carried out so that the total duration of the wash cycle was kept constant for all experiments (30 min). The surfactant formulation applied comprised a mixture of Linear Alkylbenzene Sulphonate (LAS) and Alcoholethoxylate Nonionic (NI) at a ratio 1:1.

The LAS had an average carbon chain length of 11.5. The NI was Neodol 23-5 (ex Shell), with a carbon chain lengths mixture of C12 and C13 and with on average 5 ethyleneoxide groups.

In the examples according to the invention, a 30 min wash cycle consisted of two consecutive phases of each 15 min. In the first phase, the ionic strength was equivalent to 0.01 wt % sodium chloride. In the second phase, the ionic strength was increased stepwise by an addition of sodium chloride to bring the salt concentration at 1.0 wt % (or 0.17 M) or 4.0 wt % (or 0.68 M). Within a period of one to two minutes the sodium chloride was dissolved completely.

In the respective comparative examples, the salt concentration was constant during the whole wash cycle (30 min), i.e., 1.0 wt % and 4.0 wt %, respectively.

The experiments were carried out in a standard Terg-O-Tometer beaker at a constant wash temperature of 27° C. After washing of in total duration of 30 minutes and two times rinsing with tap water during 2 minutes at room temperature the changes in the reflectance was measured. Two monitors were applied: Dirty Motor Oil (DMO) on Polyester/Cotton and AS9 (a standard test cloth from CFT). Of these monitors three pieces were present per wash. The washes were carried out in duplicate experiments (runs). Reflectance changes were expressed as ΔR460 (reflectance change at a wavelength of 460 nm). The results clearly demonstrated the better removal of DMO with the application of the salt in the second wash phase only, in comparison to the use of salt during the whole wash period.

On the AS9 cloth, the decrease in performance normally observed with salt applied during the total wash phase is not found with the salt in the second wash phase.

On unsoiled white cotton and polyester monitors also present in the beakers redepositon was monitored. There were no differences in redeposition as a function of the salt level in the various experiments.

EXAMPLE 2

For this example, experiments were carried out in Miele Softtronic W4135 washing machines using an isothermal "30° C. colored/white" washing programme. The main wash in this programme lasted about 55 minutes.

The surfactant formulation applied comprised a mixture of Linear Alkylbenzene Sulphonate (LAS) and alcoholethoxylate nonionic (NI) at a ratio of 1:1. This surfactant system is equal to that applied in example 1. The total surfactant concentration in the wash liquor was about 0.1% wt. (1.0 g/L).

The effect of NaCl salt on the cleaning performance of this surfactant system was investigated by adding 0.25% wt and 4.0 % wt NaCl approximately halfway the main wash. In the comparative examples, the NaCl concentration was kept constant during the whole main wash cycle, at 0% wt, 0.25% wt and 4.0% wt respectively.

The following general conditions were applied:

use of 10 mM tris(hydroxymethyl)methylamine buffer, for obtaining a pH-value of 9.4-9.8.

no other laundry ingredients were applied.

Use of demineralised water.

2.6 kg clean cotton wash load in 13 l water, so Liquid/Cloth ratio is 5.

After washing in the washing machine and two times rinsing with tap water during 2 minutes at room temperature, the changes in reflectance were measured using a Minolta CM-3700d spectrophotometer.

Various monitors were applied including Dirty Motor Oil (DMO) on Polyester/Cotton and AS9. Of these monitors two pieces were present per wash and each wash condition was duplicated. The reflectance changes were expressed as ΔR460.

The results obtained clearly show the better removal of DMO when adding the NaCl salt halfway the main wash cycle as compared to the addition of the salt at the beginning of the main wash cycle. Furthermore, on the AS9 test cloth, no clear decrease in cleaning performance was observed when adding the salt halfway the wash cycle. In addition, no differences in redeposition on unsoiled white cotton and polyester monitors were found as a result of the various washing tests.

These results confirm the effects on the cleaning performance of the LAS/NI 5EO surfactant system using a standard Terg-O-Tometer, as observed in example 1.

The invention claimed is:

1. A method of enhancing removal of dirty motor oil from polyester/cotton which method comprises washing a laundry fabric comprising said polyester/cotton in a wash liquor in a washing machine, said wash liquor containing surfactant material, wherein during a single wash cycle no more than 10% by weight of the wash liquor is drained from the washing machine, wherein the concentration of the surfactant material in the wash liquor is substantially constant during the wash cycle, and wherein said method comprises the step of changing the ionic strength of the wash liquor by addition of one or more ionic ingredients thereto during the wash cycle;

wherein the wash cycle comprises at least a first phase and a second phase, and wherein the ionic strength of the wash liquor is higher during the second phase than the first phase;

wherein either or both phases have a duration of from 2 to 60 minutes;

wherein during at least part of said first phase, the ionic strength of the wash liquor is from 0.001 to 0.06 M and during the second phase the ionic strength of the wash liquor is from 0.01 to 0.5 M;

wherein addition of ingredients to change ionic strength and reach the second phase is effected (1) by dosing from a dosing device attached to the machine or (2) by cycling at least part of the wash liquor through an external dosing device and back into the machine;

wherein during at least 50% of the time of variation of the ionic strength, the wash liquor has a temperature of from 5° C. to 60° C. and wherein the ionic ingredient comprises sodium, potassium or ammonium chloride salt.

2. A method according to claim 1, wherein during the wash cycle no more than 1% by weight of the wash liquor is drained from the washing machine.

3. A method according to claim 1, wherein during the wash cycle the change of the concentration of the surfactant material in the wash liquor is less than 10%.

4. A method according to claim 3, wherein the change in concentration is less than 5%.

5. A method according to claim 1, wherein during at least part of the wash cycle, the wash liquor comprises, dissolved sodium and/or magnesium ions.

6. A method according to claim 1, wherein during at least part of said first phase, ionic strength of the wash is from 0.002 to 0.04 M and during the second phase the ionic strength of the wash liquor is from 0.02 to 0.3 M.

7. A method according to claim 1, wherein either or both phases have a duration of 2 to 30 minutes.

8. A method according to claim 7, wherein either or both phases have a duration of 3 to 20 minutes.

9. A method according to claim 1, wherein during at least 50% of the time of variation of ionic strength, the wash liquor has a temperature of 5° C. to 38° C.

* * * * *